US005743125A

United States Patent [19]

Kneppe et al.

[11] Patent Number: 5,743,125

[45] Date of Patent: Apr. 28, 1998

[54] HOT STRIP PRODUCTION PLANT FOR ROLLING THIN ROLLED STRIP

[75] Inventors: Günter Kneppe, Hilchenbach; Dieter Rosenthal, Niederfischbach; Stephan Krämer, Hilchenbach, all of Germany

[73] Assignee: SMS Schloemann-Siemag Aktiengesellschaft, Dusseldorf, Germany

[21] Appl. No.: 701,969

[22] Filed: Aug. 23, 1996

[30] Foreign Application Priority Data

Sep. 6, 1995 [DE] Germany ..... 195 32 792.6
Oct. 11, 1995 [DE] Germany ..... 195 38 341.9

[51] Int. Cl.[6] ..... B21B 27/06; B21B 41/00

[52] U.S. Cl. ..... 72/201; 72/202; 72/200; 72/227

[58] Field of Search ..... 72/200, 201, 202, 72/227, 229, 234, 40, 366.2

[56] References Cited

U.S. PATENT DOCUMENTS 4,505,141 3/1985 Thomas et al. ..... 72/201
4,782,683 11/1988 Tippins et al. ..... 72/201
5,140,837 8/1992 Thomas et al. ..... 72/229
5,150,597 9/1992 Sekiya et al. ..... 72/229
5,329,688 7/1994 Aryedi et al. ..... 72/201
5,540,074 7/1996 Smith et al. ..... 72/229

OTHER PUBLICATIONS

Patent Abstracts of Japan, vol. 011, No. 380 (M-650), Dec. 11, 1987 & JP-A-62 151209 (Sumitomo Metal Ind Ltd), Jul. 6, 1987.

*Primary Examiner*—Lowell A. Larson
*Assistant Examiner*—Rodney A. Butler
*Attorney, Agent, or Firm*—Friedrich Kueffner

[57] ABSTRACT

A production plant for producing hot-rolled flat products includes a rolling train composed of a plurality of roll stands, a run-out table with devices for cooling the hot strip, and with subsequently arranged coiling machines for coiling the strip. At least the first roll stand of the rolling train is a reversing stand. At least one reeling furnace each is arranged in front of and following the reversing stand. A controllable cooling unit is provided between the reversing stand and the reeling furnace in front of the reversing stand.

11 Claims, 1 Drawing Sheet

HOT STRIP PRODUCTION PLANT FOR ROLLING THIN ROLLED STRIP

BACKGROUND OF THE INVENTION

1. Field of the Invention

The present invention relates to a production plant for producing hot-rolled flat products. The production plant includes a rolling train composed of a plurality of roll stands, a run-out table with devices for cooling the hot strip, and with subsequently arranged coiling machines for coiling the strip.

2. Description of the Related Art

Rolling plants for producing hot-rolled strip are generally constructed and operated today in such a way that the deformation in the individual stands takes place austenitically; this means that it is ensured that the rolling temperatures in the individual roll stands are above the GOS line ($A_3$ linne) of the iron/carbon diagram. Cooling to reeling temperature with a structure transformation in the cooling stretch or in the wound-up coil takes place only after the last pass which, for obtaining a fine-grained final structure, should be as close as possible to the GOS line.

In the case of low alloy carbon steels, for rolling in accordance with the above-described method, the final rolling temperature, i.e., the temperature in the last roll stand of the rolling train, is about 8400° to 920° C., depending on the carbon content. The final rolling temperature is maintained by changing the final rolling speed, wherein the drive power of the roll stands is capable of controlling the natural cooling of the strip in the rolling train and the supply of heat. This method can be used without problems for strip thicknesses above a minimum strip thickness, which, depending on the type of rolling train, is in the order of magnitude of 1.3 mm. If the wall thickness drops below this minimum thickness, the required rolling speed reaches values above 12 meters per second at the strip head; this speed is so high that the strip can no longer be handled at the free runout on the roller table following the rolling train.

In spite of the problems discussed above, the tendency is to develop smaller final thicknesses; this means that the tendency was to reduce the final rolling temperature in order to facilitate slower rolling speeds. These rolling processes have become known under the name ferritic rolling because they take place at temperatures below the GOS line, i.e., in the range of the $\alpha$, $\gamma$ mixed crystals or below the GPS line (border line of homogenous ferritic crystals) in the ferritic range.

In accordance with a preferred method, a break-down rolling is carried out in the austenitic range to an intermediate thickness of 2 to 8 mm and finish rolling is carried out in the ferritic range to the smallest final thicknesses below 1.3 mm. Between these two process stages, the rolling stock must be cooled from the final rolling temperature in the austenitic range to the rolling temperature in the ferritic range. This means a cooling from the temperature range of 840° C. to 920° C. to the temperature range of 600° C. to 780° C.

The final rolling temperature following the second deforming stage is also in the range of 600° to 780° C. and, thus, in an order of magnitude in which a recrystallization of the structure occurs after reeling in the wound-up coil. A structure is produced which facilitates the use of the product without further cold deformation or heat treatment.

An essential requirement for a good result is that a minimum cooling time is maintained for cooling from the austenitic range into the ferritic range. This minimum cooling time must be maintained in order to make it possible that the transformation from austenite to ferrite can take place to a sufficient extent. Depending on the selected temperature and alloy composition, this minimum cooling time for entering the first ferritic transformation is in. the order of magnitude of a few seconds to several minutes.

The realization of the above-described process is very difficult in a conventional rolling train for hot-rolled wide strip. The transformation from the austenitic range into the ferritic range should be carried out in the thickness range of 2 mm to 8 mm, i.e., in a thickness range in which the rolling stock is approximately in the middle of a conventional finishing train. Since the travel time of the strip from one stand to the next stand in the middle of the finishing train takes only a few seconds, it is possible in principle to realize the cooling, however, it is not possible to realize the time required for the transformation. Accordingly, in a conventional rolling train for rolling hot-rolled wide strip, it is not possible to carry out ferritic rolling in accordance with the above-described method.

SUMMARY OF THE INVENTION

Therefore, it is the primary object of the present invention to provide a production plant for rolling hot strip in which the above-described disadvantages and problems are eliminated. In addition, with a desired limitation of the run-out speed, a selectable portion of the reduction of the strip should take place in the ferritic range.

In accordance with the present invention, at least the first roll stand of the rolling train is a reversing stand. At least one reeling furnace each is arranged in front of and following the reversing stand. A controllable cooling unit is provided between the reversing stand and the reeling furnace in front of the reversing stand.

A production plant constructed in accordance with the present invention can be operated in the austenitic range as is the case in conventional plants. For this purpose, the rolling stock supplied from a roughing train or a thin slab casting machine, which usually has a thickness of 50 mm to 100 mm, is heated in a furnace to about 1100° C. and is rolled in the reversing train or Steckel train composed of one or more stands by adjusting one or more stands of the train; subsequently, the rolling stock is wound in the Steckel furnace or reeling furnace following the Steckel train. After reversing the Steckel train, the strip is pulled from the Steckel furnace and is rolled down to a thickness of about 5 mm to 15 mm in one or more stands of the Steckel train and is subsequently wound. up in the Steckel furnace on the entry side. At this point, the temperature of the strip is still above 850° C. The strip is now unwound from the Steckel furnace on the entry side and is rolled down to a thickness of about 1 mm in the Steckel stands and in the remainder of the rolling train, and the strip is coiled by the coiling machine.

In accordance with another feature of the present invention, a heating unit may be provided between the Steckel train and the remainder of the rolling train in order to ensure that the strip is not cooled too much.

It is also possible to arrange a cooling unit in front of the point where the rolled strip is wound up in the Steckel furnace on the entry side, wherein the cooling unit cools the strip having a thickness of about 5 mm to 15 mm to temperatures below 850° C. After the ferritic transformation, the strip can be rolled in the Steckel train and the remainder of the rolling train into a strip having a thickness of about 1 mm.

The heating unit following the Steckel train and located in front of the remainder of the rolling train can be omitted if all stands of the rolling train are reversing stands. This rolling train also makes it possible to roll exclusively in the austenitic range as well as in the austenitic and ferritic range. In this production plant, only that number of reversing stands is adjusted during the first rolling pass as are required for achieving a strip thickness which can be wound up in the reeling furnace on the exit side. In the second pass, the adjustments are carried out in such a way that the reversing train produces a strip thickness of about 5 mm to 15 mm. Also in this case, prior to winding up the strip in the reeling furnace on the entry side, a decision is made by switching on or off the cooling unit whether rolling in the following passes is to be carried out in the ferritic range or in the austenitic range.

In accordance with another feature, it is also possible to omit the reeling furnace on the exit side. Instead, the run-out table is constructed in such a way that the continuously cast strip can be placed on the run-out table preferably without having been rolled in the reversing train. After reversing, the strip is rolled down to a thickness of about 5 mm to 15 mm in the reversing train, wherein also in this case, prior to winding the strip onto the reeling furnace on the entry side, a decision is made, by switching on or off the cooling unit, whether rolling is to take place in the ferritic range or in the austenitic range during the following rolling procedure.

In accordance with another feature, two reeling furnaces may be provided at the entry of the reversing train. In that case, one of the reeling furnaces can be adjusted to a temperature required for rolling in the austenitic range, while the second reeling furnace can be adjusted to a temperature required for rolling in the ferritic range. However, it is also possible to hold both furnaces at temperatures required for the ferritic range and to operate the furnaces alternatingly, so that the possibly relatively long periods required for the ferritic transformation do not cause a standstill of the plant.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DESCRIPTION OF THE PREFERRED EMBODIMENTS

Figure 1:
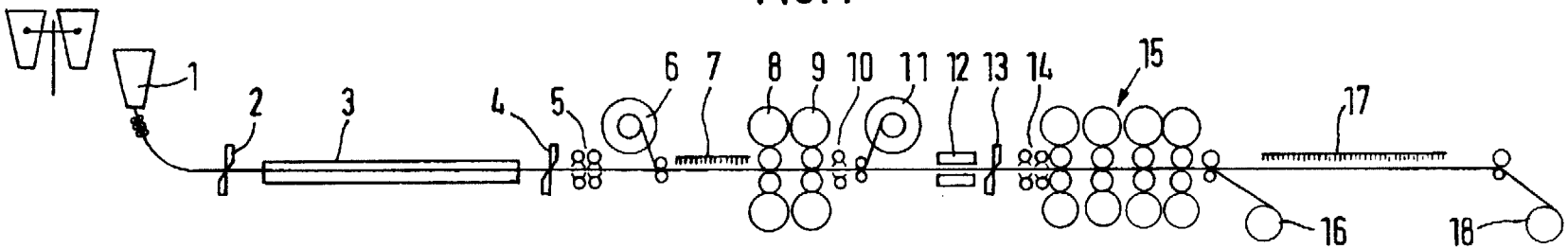
FIG. 1 is a schematic side view of a production plant according to the present invention with a reversing train, wherein the remainder of the rolling train is a continuous train.

FIG. 1 of the drawing shows a continuous casting plant 1 followed by a shearing machine 2, a furnace 3, a shearing machine 4 and a descaling unit 5. The shearing machine 4 is only intended for emergency cuts. The plant additionally includes a Steckel furnace or reeling furnace 6 followed, if required, by a controllable cooling unit for cooling the strip if necessary into the ferritic range. Next are two reversing stands 8, 9, another descaling unit 10 to be switched on when required, as well as a Steckel furnace or reeling furnace 11 on the exit side.

As described above, the continuously cast initial strip is rolled in the reversing stands 8, 9 to a thickness of about 5 mm to 15 mm and the strip is wound up in the reeling furnace 6. At this point, the strip may still have austenitic temperatures or, after cooling in the cooling unit 7, the temperatures of the strip may now only be in the ferritic range.

The reversing train is followed by a heating unit 12, preferably an induction furnace, which heats the strip as necessary to a temperature in the austenitic or ferritic range as required for the remainder of the rolling train. The heating unit 12 is followed by another shearing machine 13, a descaling unit 14, the rolling train 15, a coiling machine 16, a cooling stretch 17 and another coiling machine 18.

In the plant shown in FIG. 5, the heating unit 12 is omitted and the reeling furnace 11 is placed at the end of a reversing train. In that case, the reeling furnace 6 is followed by a cooling unit and/or descaling unit 19 which is followed by the reversing train 20. Provided at the exit of the reversing train 20 is another cooling unit and/or descaling unit 21 which is followed by the reeling furnace 11.

Figure 2:
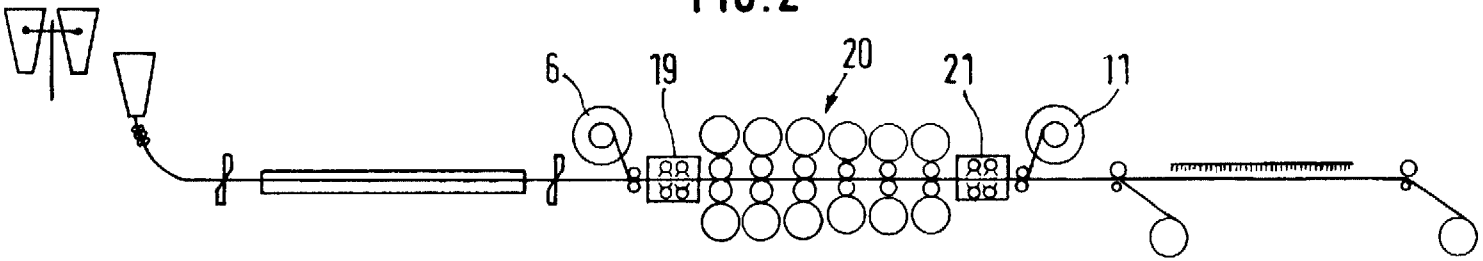
FIG. 2 is a side view of a production plant according to the present invention in which all stands are reversing stands.
Figure 3:
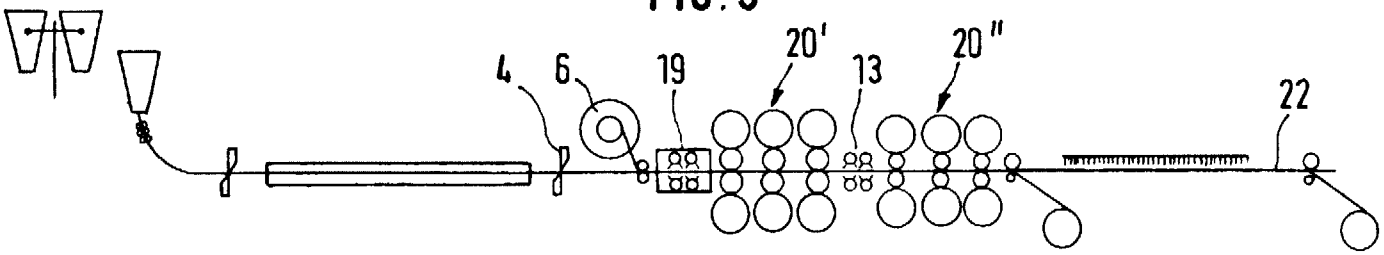
FIG. 3 is a side view of a production plant according to the present invention in which all stands are reversing stands, wherein, however, a run-out table having an appropriate length is provided instead of a reeling furnace at the exit side.

FIG. 3 shows a plant similar to the plant of FIG. 2. In FIG. 3, following the emergency shearing machine 4 is arranged the reeling furnace 6 which is followed by the cooling unit and/or descaling unit 19, the reversing train 20', the descaling unit 14, the reversing train 20" and a roller table 22.

The remaining units provided at the entry and exit sides of the production plant of FIGS. 2, 3 correspond to those of FIG. 1.

While specific embodiments of the invention have been shown and described in detail to illustrate the inventive principles, it will be understood that the invention may be embodied otherwise with-out departing from such principles.

We claim:

1. A production plant for hot-rolled flat products in the form of strip, the production plant comprising a rolling train including a plurality of roll stands, a run-out table including devices for cooling the strip, and subsequently arranged coiling machines for coiling the strip, wherein at least a first of the roll stands of the rolling train is a reversing stand, at least one reeling furnace each being arranged in front of the reversing stand the cooling unit being controlled so as to be switched on or off in dependence on whether rolling in subsequent passes is to be carried out in the ferritic or austenitic range and following the reversing stand, and wherein a controllable cooling unit is arranged between the reversing stand and the reeling furnace in front of the reversing stand, further comprising a heating unit arranged between the reversing stand and a stand of the rolling train following the reversing stand.

2. The production plant according to claim 1, comprising a cooling unit arranged between the reversing stand and a stand of the rolling train following the reversing stand.

3. The production plant according to claim 1, wherein a second of the stands of the rolling train is a reversing stand, and wherein a cooling unit is arranged between the second reversing stand and a stand of the rolling train following the second reversing stand.

4. The production plant according to claim 1, wherein all stands of the rolling train are reversing stands.

5. The production plant according to claim 1, comprising a reeling furnace configured to be operated at a predetermined furnace temperature is arranged in front of the first roll stand.

6. The production plant according to claim 1, comprising two reeling furnaces arranged in front of the first roll stand, wherein the reeling furnaces are configured to be operated at different temperatures.

7. The production plant according to claim 2, wherein the heating unit comprises descaling units.

8. The production plant according to claim 7, wherein the run-out table has a length corresponding to a length of an unrolled section of a cast strand.

9. The production plant according to claim 4, comprising a coiling machine following the rolling train.

10. A production plant for hot-rolled flat products in the form of strip, the production plant comprising a rolling train including a plurality of roll stands, a run-out table including devices for cooling the strip, and subsequently arranged coiling machines for coiling the strip, wherein at least a first of the roll stands of the rolling train is a reversing stand, further comprising at least one reeling furnace each arranged in front of the reversing stand and following the reversing stand, and wherein a controllable cooling unit is arranged between the reversing stand and the reeling furnace in front of the reversing stand wherein a second of the stands of the rolling train is a reversing stand, and wherein a heating unit is arranged between the second reversing stand and a stand of the rolling train following the second reversing stand.

11. The production plant according to claim 1, wherein the cooling unit comprises descaling units.

* * * * *